US010238196B2

(12) United States Patent
DeBenedictis

(10) Patent No.: US 10,238,196 B2
(45) **Date of Patent: *Mar. 26, 2019**

(54) HAIR STYLING AID

(71) Applicant: TF3 LIMITED, Birmingham (GB)

(72) Inventor: Alfredo DeBenedictis, Bedford (GB)

(73) Assignee: TF3 LIMITED, Birmingham, West Midlands (GB)

( * ) Notice: Subject to any disclaimer, the term of this patent is extended or adjusted under 35 U.S.C. 154(b) by 123 days.

This patent is subject to a terminal disclaimer.

(21) Appl. No.: 15/227,503

(22) Filed: Aug. 3, 2016

(65) Prior Publication Data

US 2016/0353853 A1 Dec. 8, 2016

Related U.S. Application Data

(60) Continuation of application No. 14/490,736, filed on Sep. 19, 2014, now Pat. No. 9,854,891, which is a (Continued)

(30) Foreign Application Priority Data

Dec. 17, 2007 (GB) ..... 0724555.8

(51) Int. Cl.
*A45D 1/04* (2006.01)
*A45D 6/02* (2006.01)

(Continued)

(52) U.S. Cl.
CPC ..... *A45D 1/04* (2013.01); *A45D 2/02* (2013.01); *A45D 2/367* (2013.01); *A45D 6/00* (2013.01);

(Continued)

(58) Field of Classification Search
CPC ... A45D 6/00; A45D 6/02; A45D 6/04; A45D 1/04; A45D 2/02; A45D 2/367;

(Continued)

(56) References Cited

U.S. PATENT DOCUMENTS 1,609,810 A 12/1926 Gates
1,636,967 A 7/1927 Perry (Continued)

FOREIGN PATENT DOCUMENTS

DE 172581 C 2/1905
EP 1417906 A1 5/2004

(Continued)

OTHER PUBLICATIONS

"Jan. 6, 2014 Notice of Allowance issued in U.S. Appl. No. 13/740,216 by Rachel Running Steitz".

(Continued)

*Primary Examiner* — Cris L. Rodriguez
*Assistant Examiner* — Brianne Kalach
(74) *Attorney, Agent, or Firm* — Hultquist PLLC; Steven J. Hultquist

(57) ABSTRACT

A hair styling aid, in particular for curling hair, is described. The hair styling aid includes a handle and a housing connected to the handle, the housing having: guide means for receiving a length of hair to be styled, the guide means being provided by an aperture in the housing through which the length of hair is admitted into the housing in use; a rotatable element in the housing, rotatable relative to the guide means; a motor for rotating the rotatable element in a clockwise direction or in an anticlockwise direction; and an elongate member around which, in use, the length of hair is wound by the rotatable element; wherein the rotatable element has two hair-pushing surfaces, one of the hair-pushing surfaces being oriented for pushing hair when the element is rotated clockwise and the other of the hair-pushing surfaces being oriented for pushing hair when the element is rotated anticlockwise in use.

24 Claims, 12 Drawing Sheets

Related U.S. Application Data continuation of application No. 13/633,060, filed on Oct. 1, 2012, now Pat. No. 8,869,808, which is a division of application No. 12/808,646, filed as application No. PCT/GB2008/004146 on Dec. 17, 2008, now Pat. No. 8,607,804.

(51) Int. Cl.

| | |
|---|---|
| ***A45D 2/02*** | (2006.01) |
| ***A45D 2/36*** | (2006.01) |
| ***A45D 20/12*** | (2006.01) |
| ***A45D 6/00*** | (2006.01) |
| ***A45D 7/02*** | (2006.01) |

(52) U.S. Cl.
CPC ..... *A45D 6/02* (2013.01); *A45D 7/02* (2013.01); *A45D 20/12* (2013.01); *A45D 2200/057* (2013.01)

(58) Field of Classification Search
CPC . A45D 20/12; A45D 7/02; A45D 2/36; A45D 2200/057
See application file for complete search history.

(56) References Cited

U.S. PATENT DOCUMENTS

| | | | | |
|---|---|---|---|---|
| 1,806,711 | A | 5/1931 | Salzman | |
| 1,827,785 | A | 10/1931 | Frederics | |
| 1,831,487 | A | 11/1931 | Elam | |
| 1,877,776 | A | 9/1932 | Pezzella | |
| 1,884,305 | A | 10/1932 | Shelton | |
| 1,894,624 | A | 1/1933 | Marcel | |
| 1,895,653 | A | 1/1933 | Fisher | |
| 1,981,362 | A | 11/1934 | Joyce | |
| 2,595,844 | A | 5/1952 | Graham | |
| 2,791,225 | A | 5/1957 | Simmons | |
| 2,867,223 | A * | 1/1959 | Anzalone ..... | A45D 2/06 132/256 |
| 2,906,272 | A | 9/1959 | Heidel | |
| 2,935,070 | A | 5/1960 | Auz | |
| 3,213,859 | A | 10/1965 | Mizell et al. | |
| 3,213,860 | A | 10/1965 | Mizell et al. | |
| 3,223,093 | A | 12/1965 | Winters | |
| 3,255,765 | A | 6/1966 | Sturdivant | |
| 3,786,819 | A | 1/1974 | Cantrell | |
| 3,805,810 | A | 4/1974 | Savala | |
| 3,835,292 | A | 9/1974 | Walter et al. | |
| 3,968,805 | A | 7/1976 | Sobeck, Jr. | |
| 4,148,330 | A | 4/1979 | Gnaga | |
| 4,177,824 | A | 12/1979 | Gnaga | |
| 4,222,398 | A | 9/1980 | Fromman | |
| 4,829,156 | A | 5/1989 | Thompson | |
| 4,884,583 | A | 12/1989 | Long, Jr. | |
| 5,119,847 | A | 6/1992 | Powell et al. | |
| 5,472,003 | A | 12/1995 | Frame et al. | |
| 5,584,309 | A | 12/1996 | De Beneditis et al. | |
| 5,771,906 | A | 6/1998 | De Benedictis | |
| 5,813,419 | A | 9/1998 | Brams | |
| 6,637,441 | B2 | 10/2003 | Kennedy et al. | |
| 6,647,989 | B1 | 11/2003 | De Benedictis | |
| 6,962,159 | B1 | 11/2005 | Adam | |
| 7,121,285 | B2 | 10/2006 | Kraus | |
| 7,198,049 | B2 | 4/2007 | Elmer et al. | |
| 7,305,995 | B2 | 12/2007 | Tojo et al. | |
| 7,487,783 | B2 | 2/2009 | Saito et al. | |
| 7,500,487 | B2 | 3/2009 | Kobayashi et al. | |
| 7,513,259 | B2 | 4/2009 | Kimata et al. | |
| 7,770,586 | B2 | 8/2010 | Tojo et al. | |
| 7,789,093 | B2 | 9/2010 | Tojo et al. | |
| 8,132,575 | B2 | 3/2012 | Tojo et al. | |
| 8,256,438 | B2 | 9/2012 | Tojo et al. | |
| 8,607,804 | B2 | 12/2013 | De Benedictis | |
| 8,651,118 | B2 | 2/2014 | De Benedictis et al. | |
| 8,733,374 | B2 | 5/2014 | De Benedictis et al. | |
| 8,869,808 | B2 | 10/2014 | De Benedictis | |
| 9,027,570 | B2 | 5/2015 | De Benedictis et al. | |
| 9,138,039 | B2 | 9/2015 | De Benedictis et al. | |
| 2004/0231689 | A1 | 11/2004 | Kobayashi et al. | |
| 2004/0231690 | A1 | 11/2004 | De Benedictis | |
| 2004/0237991 | A1 | 12/2004 | Glucksman et al. | |
| 2005/0241663 | A1 | 11/2005 | Getahun | |
| 2005/0268933 | A1 | 12/2005 | Kimata et al. | |
| 2005/0284493 | A1 | 12/2005 | Allen | |
| 2006/0124148 | A1 | 6/2006 | Tojo et al. | |
| 2006/0157078 | A1 | 7/2006 | Tojo et al. | |
| 2007/0017541 | A1 | 1/2007 | Wilmore | |
| 2007/0065489 | A1 | 3/2007 | Tojo et al. | |
| 2007/0068547 | A1 | 3/2007 | Gurth et al. | |
| 2007/0084479 | A1 | 4/2007 | Ryan-Jakimas | |
| 2008/0035167 | A1 | 2/2008 | Chan | |
| 2008/0236610 | A1 | 10/2008 | Bartels | |
| 2008/0302381 | A1 | 12/2008 | Tojo et al. | |
| 2009/0056738 | A1 | 3/2009 | Tojo et al. | |
| 2010/0083978 | A1 | 4/2010 | Hottenrott et al. | |
| 2010/0170883 | A1 | 7/2010 | Legrain et al. | |
| 2010/0263684 | A1 | 10/2010 | De Benedictis | |
| 2011/0220141 | A1 | 9/2011 | Chan | |
| 2012/0186601 | A1 | 7/2012 | Ungar et al. | |
| 2013/0025621 | A1 | 1/2013 | De Benedictis | |
| 2013/0125919 | A1 | 5/2013 | De Benedictis et al. | |
| 2014/0076351 | A1 | 3/2014 | De Benedictis et al. | |
| 2014/0216494 | A1 | 8/2014 | De Benedictis et al. | |
| 2015/0000689 | A1 | 1/2015 | De Benedictis | |
| 2015/0128987 | A1 | 5/2015 | De Benedictis et al. | |
| 2015/0201727 | A1 | 7/2015 | De Benedictis et al. | |
| 2015/0216281 | A1 | 8/2015 | De Benedictis et al. | |

FOREIGN PATENT DOCUMENTS

| | | | |
|---|---|---|---|
| EP | 2392222 | A1 | 12/2011 |
| FR | 641097 | A | 7/1928 |
| FR | 38041 | A | 3/1931 |
| FR | 2310105 | A1 | 11/1976 |
| GB | 303043 | A | 12/1928 |
| GB | 1036583 | A | 7/1966 |
| GB | 1157814 | A | 7/1969 |
| GB | 302952 | A | 12/1978 |
| GB | 2413492 | A | 11/2005 |
| JP | S60140502 | U | 9/1985 |
| JP | 61-10102 | U | 1/1986 |
| JP | S6278801 | U | 5/1987 |
| JP | S633808 | A | 1/1988 |
| JP | 2002520076 | A | 7/2002 |
| JP | 2005324073 | A | 11/2005 |
| WO | 0008967 | A1 | 2/2000 |
| WO | 2005082198 | A1 | 9/2005 |
| WO | 2008102317 | A2 | 8/2008 |
| WO | 2008132345 | A2 | 11/2008 |
| WO | 2009077747 | A2 | 6/2009 |

OTHER PUBLICATIONS

"Jan. 29, 2014 Office Action issued in U.S. App. No. 13/633,060 by Robyn Kieu Doan".
"Feb. 4, 2015 Notice of Allowance issued in U.S. Appl. No. 14/246,079 by Rachel Running Steitz".
"Mar. 30, 2012 Office Action in U.S. Appl. No. 12/808,646, issued by Robyn Kieu Doan".
"May 15, 2013 Office Action issued in U.S. Appl. No. 13/633,060 by Robyn Kieu Doan".
"Sep. 2012 Office Action in U.S. Appl. No. 12/808,646, issued by Robyn Kieu Doan".
"Sep. 24, 2014 Office Action issued in U.S. Appl. No. 14/246,079 by Rachel Running Steitz".

* cited by examiner

HAIR STYLING AID

CROSS REFERENCE TO RELATED APPLICATIONS

This is a continuation application under 35 U.S.C. § 120 of U.S. patent application Ser. No. 14/490,736 filed Sep. 19, 2014, which is in turn a continuation application under 35 U.S.C. § 120 of U.S. patent application Ser. No. 13/633,060 filed Oct. 1, 2012 and issued as U.S. Pat. No. 8,869,808 on Oct. 28, 2014, which in turn is a divisional application under 35 U.S.C. § 120 of U.S. patent application Ser. No. 12/808,646 filed Jun. 16, 2010, and issued as U.S. Pat. No. 8,607,804 on Dec. 17, 2013, which is a U.S. national phase application under 35 U.S.C. § 371 of International Patent Application No. PCT/GB2008/004146 filed Dec. 17, 2008, which in turn claims priority of United Kingdom Patent Application No. 0724555.8 filed Dec. 17, 2007. The disclosures of all of the foregoing applications are hereby incorporated herein by reference in their respective entireties, for all purposes.

The invention relates to a hair styling aid and particularly, but not exclusively, to a home use device for imparting curls to a length of hair.

Devices allowing users to curl their hair, either in a salon or in a home environment, are well known. Home use devices, typically known as curling irons or curling tongs, generally comprise a cylindrical heated element protruding from a handle. A sprung clamp member is pivoted to the handle and extends along the heated element. In use, the curling iron is switched on and allowed to heat up. Once at operating temperature, the user selects a length of hair, places the end of it across the heated element, and clamps it in place with the sprung clamp member. The curling iron is then rotated causing the remainder of the selected length of hair to wrap around the heated element. After a short while the curling iron is removed from the hair. The heat of the device serves to 'soften' the hair and allow it to be formed into the desired shape. Once the hair cools its original properties return and the style is set.

The heat generated by curling irons and similar devices can be harmful to the hair of a user. Although recent advances have reduced this problem, people are still advised to apply a thermal protector to their hair before using heated styling aids. Despite this advice, the extra time involved in this pre-treatment means that many users of curling irons do not use any products when curling their hair.

Further damage can be caused by the clamping and twisting of the hair during the styling process.

Furthermore, when using a curling iron it is only possible to style small sections of hair in a single application. In order for an entire head of hair to be styled, a user must repeatedly use the device on individual sections of hair, which can be time consuming.

It is an object of the present invention to provide a hair styling aid which simplifies the styling process for the user, while also being less damaging to the hair being styled.

According to the present invention there is provided a hair styling aid comprising guide means for receiving a length of hair to be styled; a rotatable element, rotatable relative to the guide means; and an elongate member around which, in use, the length of hair is wound by the rotating element. The static nature of the guide means relative to the rotatable element causes hair received by the device to be wrapped around the elongate member to create curls. Advantageously, curling of the hair starts at or near the root and moves towards the tip, in contrast to traditional methods.

Preferably, the elongate member is heated to aid the styling of the hair. The device may further comprise a housing around at least a part of the elongate member such that a, for example annular, chamber is formed between the housing walls and the elongate member, within which the hair to be styled is contained. The housing walls may extend from a handle of the device, and are preferably heated such that heat is applied to the hair from both sides during the styling process.

The size of the chamber is preferably variable. This may be achieved by incorporating an elongate member with an adjustable cross-section and/or by providing adjustable housing walls, possibly incorporating springs or similar resilient elements. One advantage of this is that the spacing between the housing wall and the hair being treated can be maintained constant as more hair is drawn into the device. This feature may also find application outside the scope of the invention as claimed. The length of the chamber and/or elongate member may also be variable, perhaps by the incorporation of telescopic sections.

Where a housing is provided on a device according to the invention, the housing may comprise the guide means. The guide means may comprise, for example, a slot or an aperture in a wall of the housing. The housing may also comprise a closable aperture through which, in use, hair to be curled is placed into the chamber. Preferably, the closable aperture opens in such a way as to provide a guide to help locate the length of hair in the device. Alternatively, hair may, in use, enter the chamber through a simple slot or aperture, which may also form the static guide means. In this case it is preferable if guide means are provided, to help locate a length of hair in the slot. For example, a pair of fins may be provided forming a 'V', at the base of which is a slot in the housing.

The rotatable element may rotate in either direction and can take any suitable form, such as a simple radial protrusion extending out from the elongate member, or a helical member so as to assist in drawing hair into the device during use. Preferably, the rotatable element comprises a planar disc with an aperture or other cut-out section displaced from its rotational centre into which, in use, hair is located. Resilient flaps or doors may be included to help maintain hair within the cut-out/aperture.

The rotatable element may rotate with the elongate member or independently thereof. The rotatable element may also be arranged to rotate with the housing, if provided. It is preferred if the rotatable element rotates relative to the elongate member.

The hair styling aid may also comprise means for dispensing a hair treatment product for application to the hair during use. Said product may be held within the device ready for application, perhaps in a canister locatable in the handle of the device or in a refillable chamber. The application of product by the device encourages a user to apply products to protect the hair during use of the device. In a particular embodiment, the device may cease to operate if insufficient product is present within the device. This may be achieved by any number of means including, but not limited to, a form of electrical sensor. For example, the sensor could take a form similar to that employed to measure ink levels in computer printers, or of a sensitive weighing device designed to register the weight of the device and alert the user and/or deactivate the device if the weight is below a certain threshold. Alternatively, a clear canister/refillable chamber could be used in conjunction with a light beam and light sensor. Operation of the device would then be determined based upon the amount of light transmitted through the product.

The hair treatment product is preferably a styling/fixing product and/or a conditioning product and/or a product designed to protect the hair e.g. from the heat of the device, but any suitable hair product could be applied.

The device may, in use, force air over the hair to be treated. This could be achieved simply as a result of the rotation of the rotatable element, or by incorporating a device such as a fan within the device, perhaps in a handle. A heating element could also be incorporated to provide a hairdryer function. If a fan is used, then this could further serve to rotate the rotatable element. In one embodiment the device may be adapted to be attached to a hairdryer. An impeller connected to the rotatable element could then be caused to rotate by the airflow from the hairdryer, in turn rotating the rotatable element. Hair treatment products could be supplied by the device, or infused into the airflow of the hairdryer.

Alternatively, the rotatable element could be rotated by a separate motor, or even by hand.

Due to the fact that the hair is not clamped by the device during the curling process, continued rotation of the rotatable element after the curling step is complete causes no damage to a user's hair. Accordingly, it is possible for the rotatable element to continue to rotate until it returns to a predefined starting position. This could be achieved simply through the judgement of a user, or by electrical or mechanical control means. For example, the device could be arranged to only operate in full rotations of the rotatable element (or defined portions thereof), or a reset function could be incorporated. The reset function could be coupled to the opening of the door in the housing, where provided.

The hair styling aid may also be provided with an adjustable extension, perhaps a telescopic spacer, which could be positioned against the head of a user to set a distance between the device and the head of a user. The adjustable extension may form a continuation of the elongate member or of the housing or be separate from both.

The device according to the invention has a number of advantages over the prior art. The ease of use simplifies and speeds up the process of styling hair while the lack of any clamping places less stress on the hair and causes less damage. The ability of the device to dispense hair products also helps to protect the hair during styling, especially where the provision of hair products is made essential to the operation of the device.

The provision of a chamber, in certain embodiments, allows heating of the hair from both sides, giving a more uniform temperature. By providing a thermally insulating surface on the exterior of the chamber, a larger portion of the device is safe to touch during operation. Indeed, the chamber may allow the device to be placed flat on a surface while warming up, without the need for a separate support.

The static nature of the device during use also allows greater control in the styling of hair. This can be further improved by the provision of an adjustable extension or spacer to allow accurate and consistent positioning of the device relative to the head of a user.

A better understanding of the present invention will be obtained from the following detailed description. The description is given by way of example only and makes reference to the accompanying drawings in which.

Figure 1:
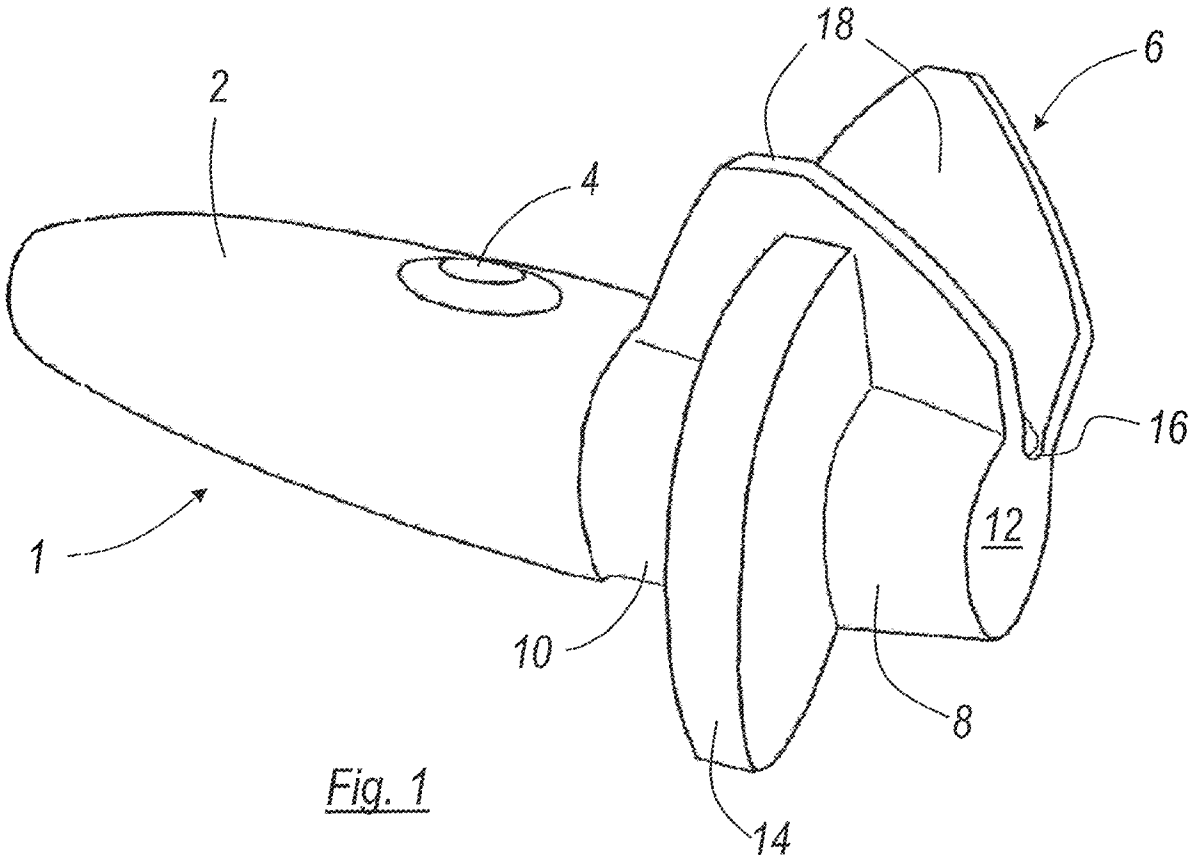
FIG. 1 is a perspective view of a hair styling device according to a first embodiment of the present invention.
Figure 16:
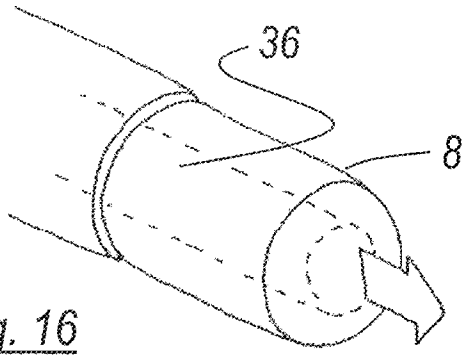
Figure 16A:
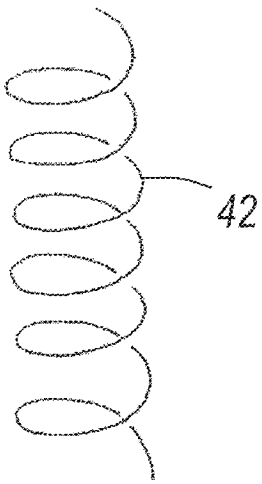
Figure 15:
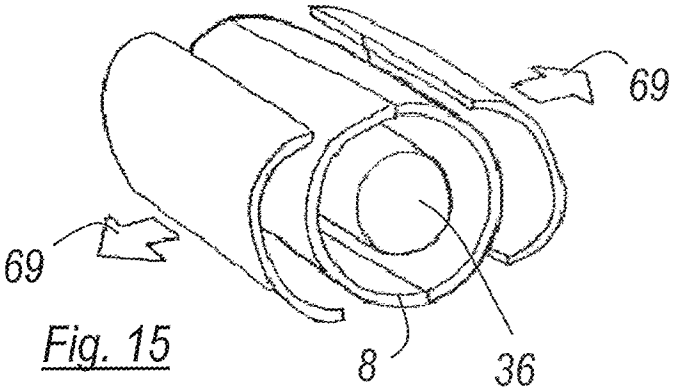
FIG. 15 is a perspective view showing a further operation of the expandable chamber of FIG. 7.
Figure 15A:
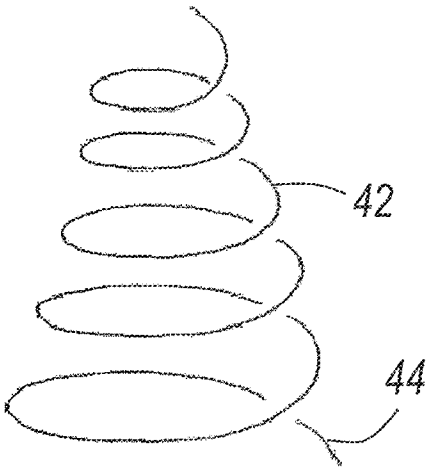

FIG. 15A schematically shows a length of hair having been treated in the chamber of FIG. 15;

FIG. 16 is a perspective view of an extendible chamber for the device of FIG. 1; and FIG. 16A schematically shows a length of hair having been treated in the chamber of FIG. 16.

FIG. 1 shows a hair styling device 1 according to one aspect of the present invention. The device 1 shown in FIG. 1 has an elongate handle 2, with controls 4 for operating the device 1, and a housing section 6 in which the hair is contained for styling. The housing 6 comprises a front chamber 8 and a rear chamber 10, which are separated by a rotatable element (not shown). The front and rear chambers 8,10 are both generally cylindrical, and are of similar diameter. The rear chamber 10 is joined to the handle 2 of the device 1, and the front chamber 8 is enclosed at an end distal to the handle 2 of the device 1 by a flat end face 12. Between the front and rear chambers 8,10 is a further cylindrical part 14 of the housing 6, which is of larger diameter than the front and rear chambers 8,10, and within which the rotatable element is enclosed. In the device 1 of FIG. 1, the axis of the elongate handle 2 is co-incident with the axis of each of the housing parts 8, 10, 14 so that the device 1 has a linear 'wand-like' configuration.

The housing 6 further comprises a slot 16 through which, in use, hair may be admitted into the housing 6. The slot 16 is provided in a side of the housing 6 and runs parallel to the axis of the device 1. A pair of guide fins 18 is provided as part of the housing, each one extending away from the sides of the slot 16 in a 'V' shape, to provide a guide for hair being placed into the housing 6 through the slot 16. As shown, the shape of the outer edge of each guide fin 18 approximately follows the contours of the housing 6, although this is not essential.

Figure 2:
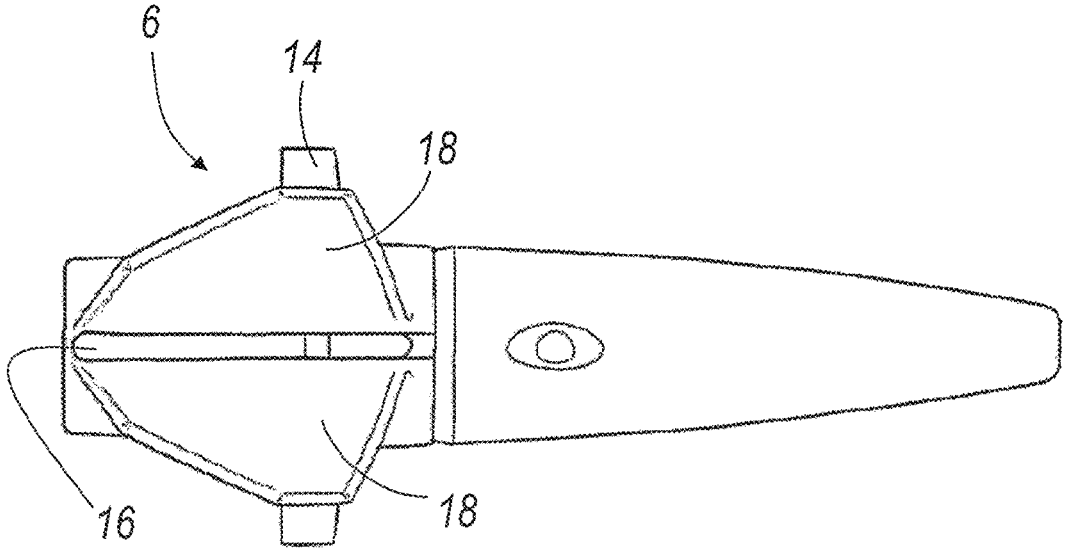
FIG. 2 is a plan view of the device of FIG. 1.
Figure 3:
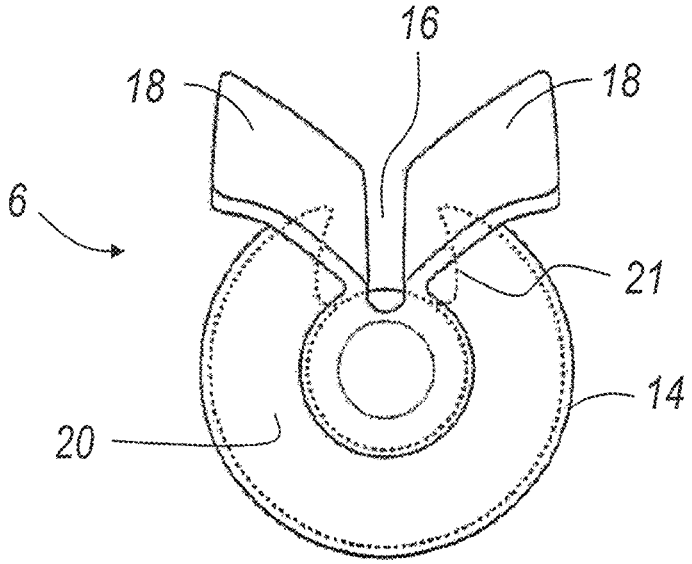
FIG. 3 is an end view of the device of FIG. 1.

The top view of FIG. 2 shows the slot 16 and guide fins 18 more clearly, as well as the wider diameter portion 14 of the housing 6. The guide fins 18 and slot 16 are also shown in the front/end view of FIG. 3. FIG. 3 also shows, in broken lines, the rotatable element 20 in position within the larger diameter part 14 of the housing 6. The rotatable element 20, which is more clearly shown in the later Figures, comprises a planar disc with a cut-out section, and is mounted to rotate within the larger diameter part 14 of the housing 6.

Figure 4:
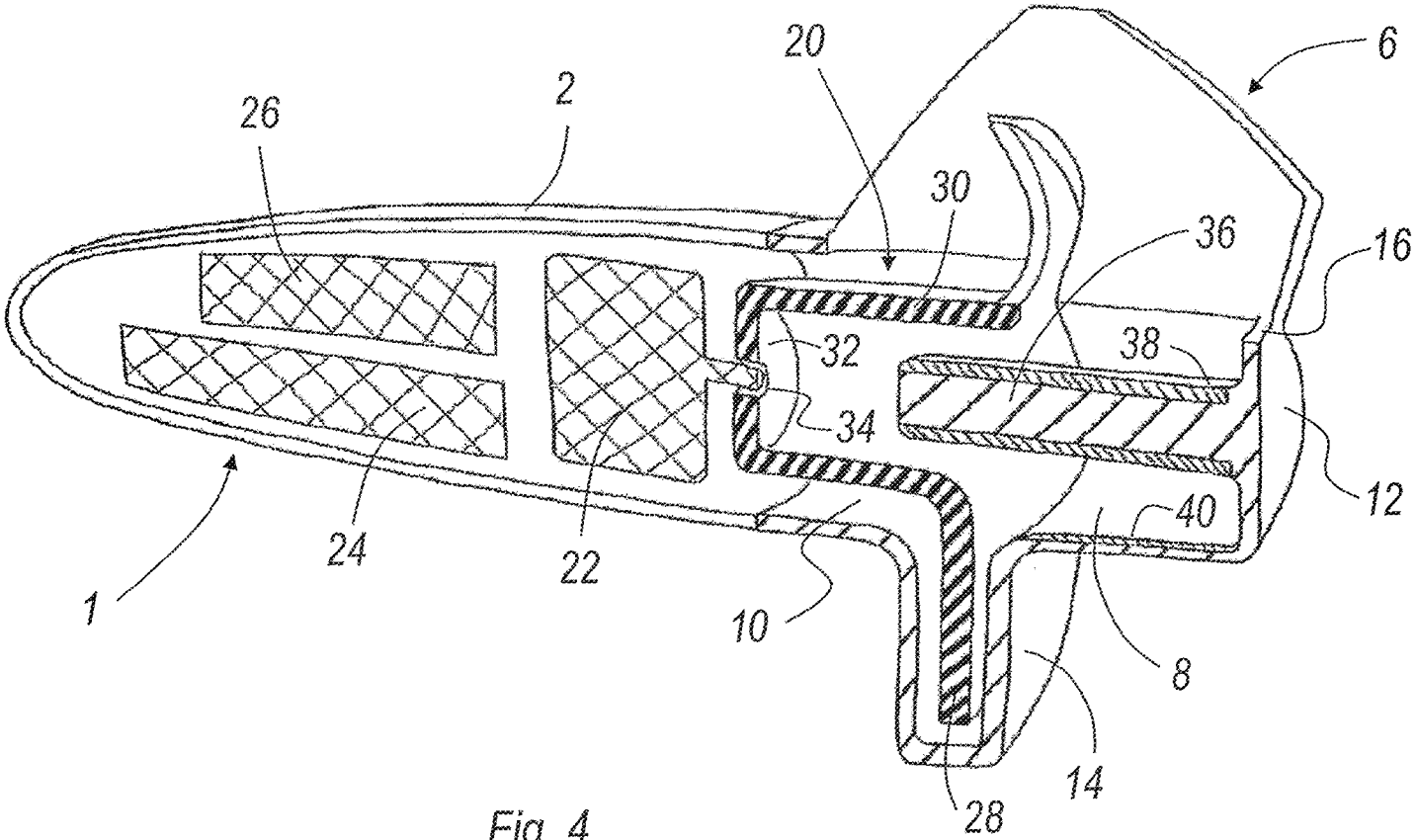
FIG. 4 is a cross-sectional perspective view of the device of FIG. 1.

FIG. 4 is a longitudinal cross-sectional view of the device 1 shown in FIG. 1. The cross-section is taken vertically through the device 1, passing through the slot 16 in the housing 6, and provides an indication of the internal workings of the device.

Inside the handle 2 of the device 1 is housed a motor 22 for rotating the rotatable element 20. The handle 2 also provides space for a power supply 24 and for hair product 26 to be applied during use of the device 1. The various components are indicated only schematically, and their precise locations and configurations may vary from those shown. More significantly, FIG. 4 also shows the interior of the housing 6 where, in use, hair to be styled is held.

The rotatable element 20 comprises a planar disc portion 28 (as shown in FIG. 3) which blends into a cup-like portion 30 with generally cylindrical side walls closed at an end distal to the disc portion 28 by a flat end face 32. The flat end face 32 is provided with an aperture 34 which enables the rotatable element 20 to be torsionally fixed to the output of the motor 22. Although a direct connection is shown, it is also possible that some form of gearing could be provided between the motor 22 and the rotatable member 20. The cup-like portion 30 of the rotatable element 20 is located within the rear chamber 10 of the housing 6, and the disc portion 28 is within the larger diameter portion 14. The front chamber 8 of the housing 6 contains a generally cylindrical elongate member 36 which extends into the housing 6 from the flat end face 12, passes through the front chamber 8, and terminates within the cup-like portion 30 of the rotatable element 20. Both the outer face 38 of the elongate member 36 and the inner walls 40 of the front chamber 8 of the housing 6 are heated.

Figure 5A:
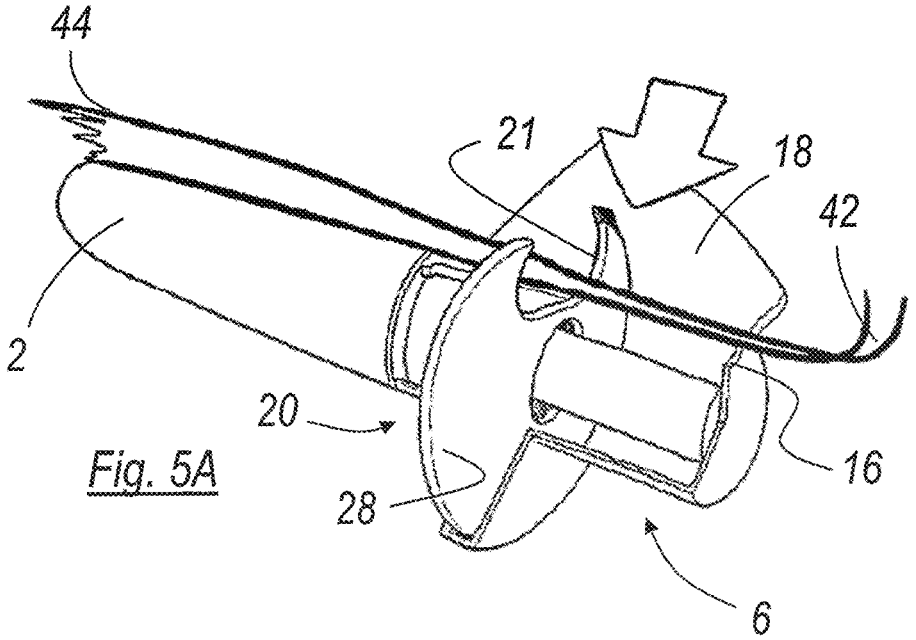
FIGS. 5A to 5C are a series of perspective views showing the device of FIG. 1 in operation.
Figure 5B:
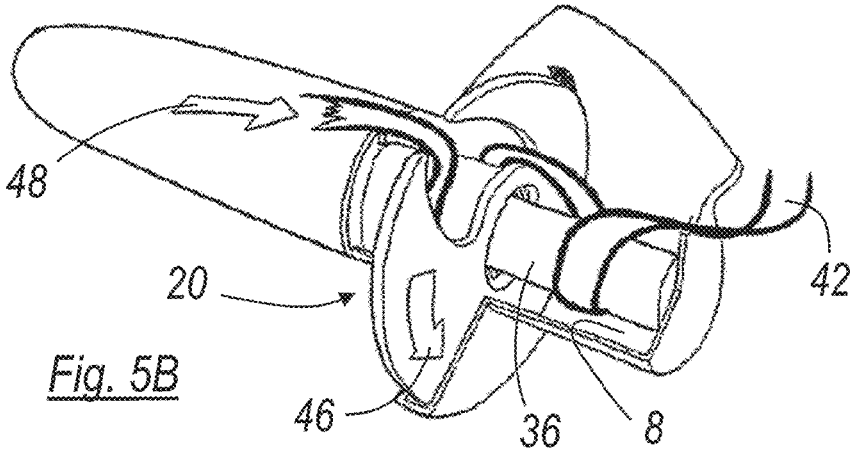
Figure 5C:
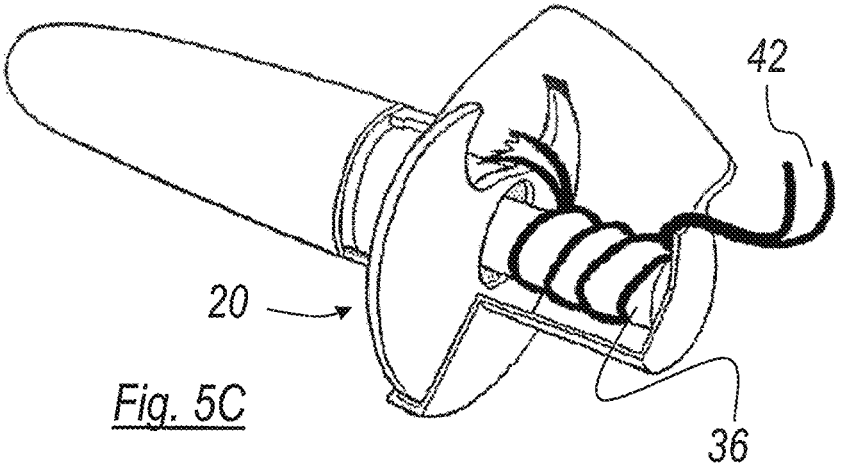

The operation of the device 1 is shown in FIGS. 5A-5C. The hair styling device 1 is switched on and allowed to warm up in the same way as conventional hair styling devices, and then positioned with the housing 6 adjacent a head of hair to be styled. As shown in FIG. 5A, a length of hair 42 is selected by a user and placed into the slot 16 with the assistance of the guide fins 18. The rotatable element 20 is configured so that the cut-out section 21 of the disc 28 is aligned with the slot 16 in the top of the housing 6. Accordingly, the length of hair 42 passes through the slot 16 and into the cut-out section 21 of the disc 28 of the rotatable element 20. The free end 44 of the length of hair 42 extends out in the direction of, and possibly beyond, the handle 2 of the device 1. In contrast to the majority of commercially available styling devices, the hair is not mechanically gripped by any part of the device 1.

FIG. 5B shows the device 1 during operation. The motor (not shown) causes the rotatable element 20 to rotate in the direction of arrow 46. The part of the length of hair 42 which is passing through the cut-out section 21 of the disc 28 of the rotatable element 20 is pushed to one side by interaction with the walls of the cut-out section 21 of the disc 28 as it rotates, while a further part of the length of hair 42, towards the root, is prevented from rotation by its location in one end of the groove 16. This wraps the length of hair 42 around the elongate member 36 while simultaneously drawing the free end 44 of the hair into the housing 6 through the other end of the groove 16 as indicated by arrow 48. Accordingly, curls are imparted first at or near the root of a length of hair 42, and subsequently to the remainder extending towards the free end 44. Initially, as shown in FIG. 5B, the length of hair 42 may be drawn into the rear chamber 10 by the rotation of the rotatable element 20, but since the hair is not gripped this is not problematic. Further rotation of the disc 28 simply causes the free hair in the rear chamber 10 to be pushed into the front chamber 8 and wrapped around the elongate member 36 as before.

Once the entire length of hair 42 has been wrapped around the elongate member 36, as shown in FIG. 5C, styling and/or treatment product may be applied to set the curls. This may be in place of or in addition to the application of heat from the heated surfaces 38,40 within the front chamber 8.

The length of hair 42 is not gripped during the curling, and is free to run through the device 1, so very little stress is placed on the hair 42 during the styling process. The rotatable element 20 simply rotates freely within the chamber 14 beyond the free end 44 of the hair. It should also be noted that, since the length of hair 42 is not gripped by any part of the device 1, continued rotation of the rotatable element 20 will cause no damage to the hair being styled. Accordingly, the rotatable element 20 may be allowed to rotate back to the position shown without risk of pulling or otherwise damaging the hair. When the curling of a particular section of hair 42 is complete, the device 1 may be removed by simply withdrawing it from the head of a user and allowing the length of hair 42 to pass through the slot guide means 16, and past the enclosed end of the housing 6.

The external walls of the housing 6, and other exposed parts of the device 1, are preferably covered with a thermally insulating material such that they remain cool to the touch when the device 1 is in operation. A flat portion (not shown) may be provided on the outside of the housing 6 opposite the slot 16 and fins 18 to allow the device 1 to rest on a flat surface while warming up. The guide fins 18 also serve to prevent the device 1 from rolling when placed on a flat surface.

Figures 6, 6A:
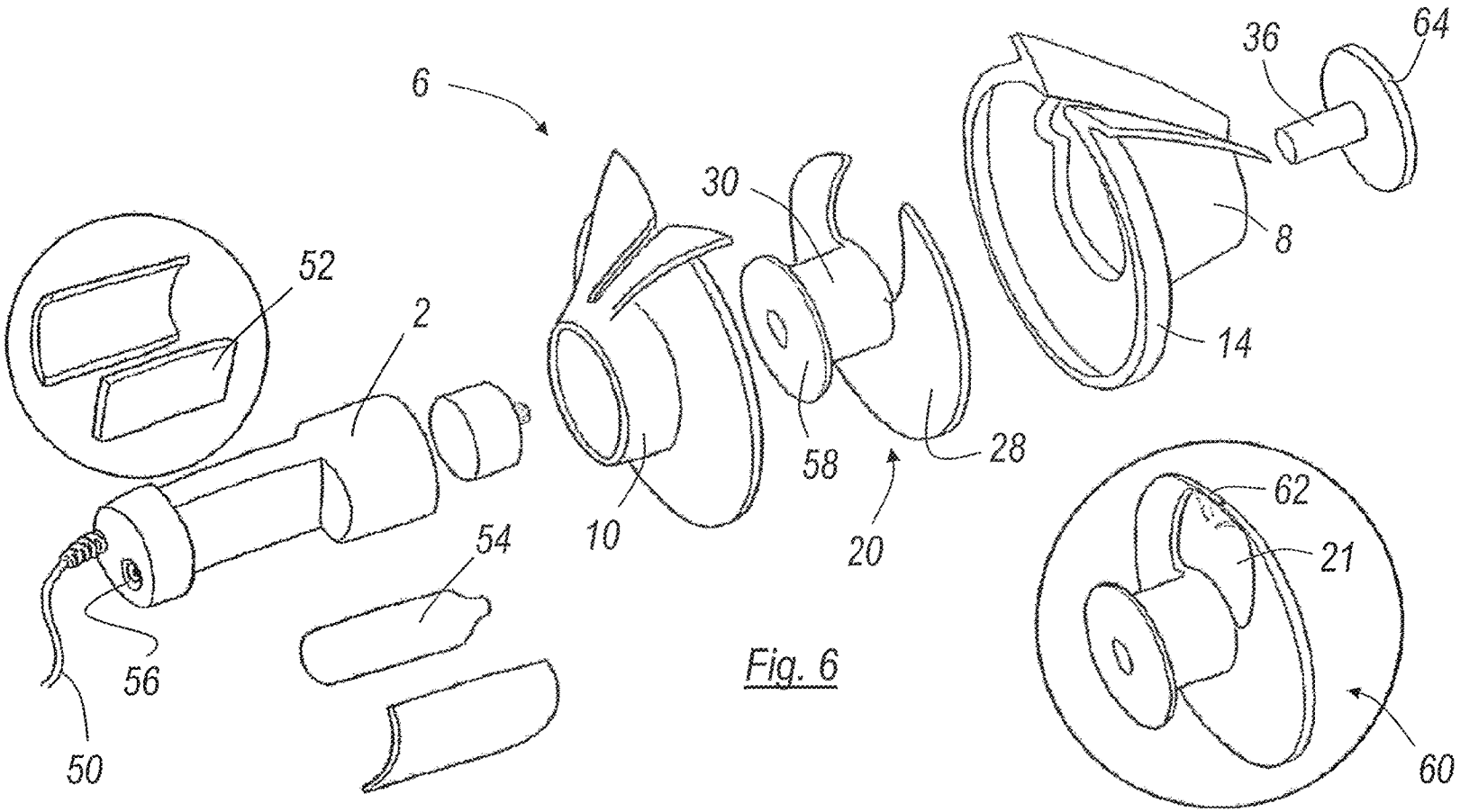
FIG. 6 is an exploded perspective view of a device similar to that shown in FIG. 1, with optional additional features shown.
FIG. 6A is a perspective view of an alternative rotatable element for the device of FIG. 1.

FIG. 6 shows an exploded view of a device 1 similar to that described above. The view of FIG. 6 shows, in a single figure, a number of features which may be applied to different embodiments of the present invention. For example, the handle portion 2 is shown with both a mains cable 50 and a battery 52; as well as with both a canister 54 and a refill valve 56, either of which may be for the supply of gas to power the device 1 or for hair product to be applied during its use.

The housing portion 6 is divided into two parts, one comprising the front chamber 8 and larger diameter part 14, and one comprising the rear chamber 10. Between these is positioned the rotatable element 20, which is as described in relation to the earlier Figures with the exception that a flange 58 is provided at the end of the cup-like portion 30 distal from the disc portion 28. FIG. 6A shows an alternative rotatable member 60 which comprises resilient flaps/doors 62 extending across the opening of the cut-out section 21. This is advantageous in ensuring that hair is retained in the cut-out section 21 during operation of the device 1. An end cap 64 is also shown, complete with elongate member 36, as a further separate component of the housing 6, although it is also possible that the front chamber 8 would be provided with an integral end face 12 and elongate member 36 as previously described.

Figure 7:
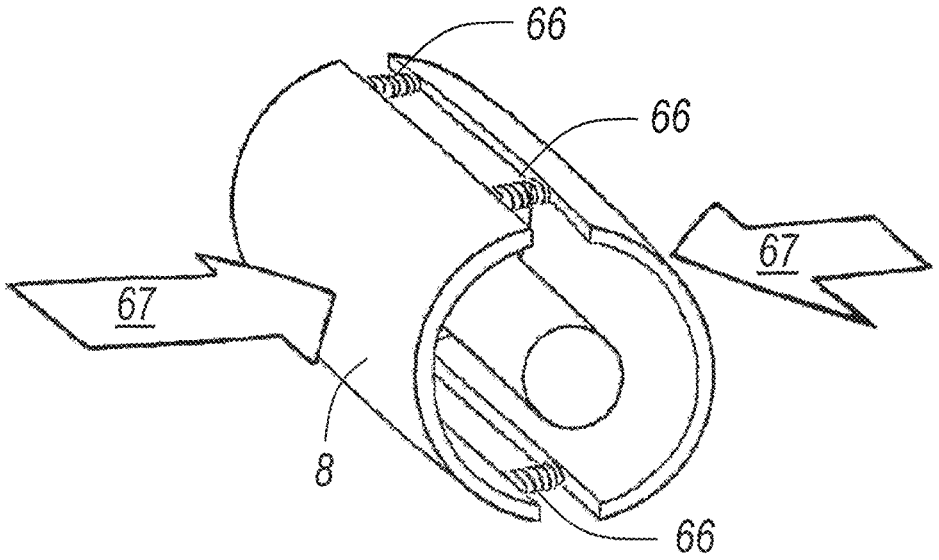
FIG. 7 is a perspective view of an adjustable housing part for the hair styling device of FIG. 1.

Preferably, the device according to the invention will be capable of forming curls of various sizes and/or accommodating different sized sections of hair for treatment. This may be achieved if the size of the annular space between the walls of the front chamber 8 and the elongate member 36 is adjustable. This can be achieved by varying the diameter of either the elongate member 36 or of the front chamber 8. FIG. 7 shows one option for varying the diameter of the front chamber 8, where springs 66 are provided, between two halves of the chamber 8, which can compress to reduce the space between the elongate member 36 and the walls of the front chamber 8. Other resilient elements are equally suitable.

One operation of the chamber shown in FIG. 7 is illustrated in FIG. 15. Whereas in FIG. 7 arrows 67 indicate a reduction of the diameter of the chamber 8, in FIG. 15 the arrows 69 indicate an expansion of the chamber diameter. As previously described, the adjustment of the size of the chamber 8 can take place before using the device 1. However, it is also possible for the chamber 8 diameter to increase during use of the device 1. This is advantageous since, especially when long hair is being treated, new hair can often end up being curled on top of previously curled hair. This causes a build up of hair which may, absent this feature, interfere with the walls of the chamber 8 causing the potential for snagging and, therefore, damage of the hair. The expansion of the chamber 8 may take place simply through the expanding curls of hair contacting the walls of the chamber 8 and overcoming the force of springs 66 or other resilient elements between the halves of the chamber 8 to bias the halves away from each other. It is preferable, however, that some other means for expansion is employed to maintain a gap between the outermost curled hair and the walls of the chamber 8. This may be achieved by some biasing means or expanding mechanism, possibly driven by a form of gearing and/or linkage from the means for rotating the rotatable element 20.

Given that the device 1 will often comprise static guide means in the form of a slot 16 or a simple aperture, a limit is placed on the volume of a section of hair that can pass into the device 1 and be treated in a single operation. This can be used to estimate the rate at which hair will build up within the device 1 as the rotatable element 20 rotates, and gearing can be selected to control the rate of expansion of the chamber 8 accordingly so that it always remains clear of the curled hair.

An alternative means of varying the size of the chamber 8 is shown in FIG. 16. Rather than expanding (or reducing) the diameter of the chamber 8, FIG. 16 shows a variant wherein the chamber 8 is telescopic and can be lengthened. Once again, this can take place before or during use of the device 1, and may be associated with/connected to the driving means for the rotatable element 20. Lengthening of the chamber 8 during operation of the device also serves the purpose of maintaining a constant gap between the hair being treated and the walls of the chamber 8. As a length of hair 42 is treated the length of the housing 8 can be extended, drawing the elongate member 36 with it. Accordingly, hair is not laid over previously curled hair during the process, but instead is curled around a fresh part of the elongate member 36. As before, the rate at which the chamber 8 lengthens may be related to the maximum thickness of a section of hair to be treated, which in turn is determined by the static guide means.

It may be necessary for the elongate member 36 to also extend as the chamber 8 extends so that a user can be sure that there will always be an available part of the elongate member around which a length of hair 42 can be curled. However, as shown in FIG. 4, the elongate member 36 can be made to extend into the rotatable element 20 such that its end is beyond the disc part 28 of the rotatable element 20. When this embodiment is used, it may not be necessary for the elongate member 36 to be extendible. The surplus of a fixed length elongate member 36 extending beyond the disc part 28 of the rotatable element 20 may be relied upon instead. Since there is no overlapping of hair, a user can be sure that the curls formed in a length of hair 42 by a device 1 having an extendible chamber 8 as shown in FIG. 16 will be a constant size, as shown in FIG. 16A. In contrast, curls formed when a length of hair 42 is laid over previously curled hair can increase along the length of hair 42 towards the free end 44, as shown in FIG. 15A.

The device 1 has a number of advantages over previous styling aids. There is no need for the hair to be clamped or gripped by the device during curling. This reduces the strain put on the hair during the styling process. Application of hair products by the device during use encourages a user to use products more frequently, which again has benefits for the health of the user's hair. In fact, it may be possible to include some means which would inhibit use of the device if a cartridge of product is not present or is exhausted.

For example, a sensitive weighing device (not shown) may be incorporated into the handle 2 of the device 1. When the device 1 is switched on and placed on a surface to warm up, the weighing device measures the weight of the canister 54 of product contained within the handle 2. If the weight is below a certain threshold this indicates either that a canister 54 is not present in the device 1, or that a canister 54 is present, but is empty or near empty. Under these circumstances activation of the device 1 may be prevented, since there is an insufficient volume of product for application. Alternative, preferably electrical, sensing means such as those used to determine the volume of ink in ink-jet printer cartridges, light sensors and the like, may also be used to determine the amount of product remaining and prevent operation of the device as required. Additionally, or alternatively, an audio or visual warning could be relayed to the user.

Conventional styling devices are designed to be used at right angles to the hair to be treated. The section of hair, once selected, is laid across the device and then wound around it to create the desired curls. In the event that curls are not required right to the base of the hair, a user must use their own skill and judgement to curl each section of hair to a consistent point. This can be difficult because of the need to manually wrap the hair around the styling device.

In contrast, the device 1 according to the invention is oriented so as to be parallel with the hair to be curled when in use. The device 1 is positioned at a predetermined point along the length of a section of hair 42. The length of hair between the housing 6 and the free end 44 is automatically drawn into the housing 6 by the rotation of the rotatable element 20, without the need for a user to move the device 1, and is curled around the central protrusion 36. Only hair held within the housing 6 is curled by the device 1, so the hair between the root and the end face 12 of the housing 6 is not affected. Since hair is curled from root to tip, the location of the device 1 does not change during use. It is therefore easier for a user to maintain a consistent point beyond which the hair will not be curled.

Figure 8:
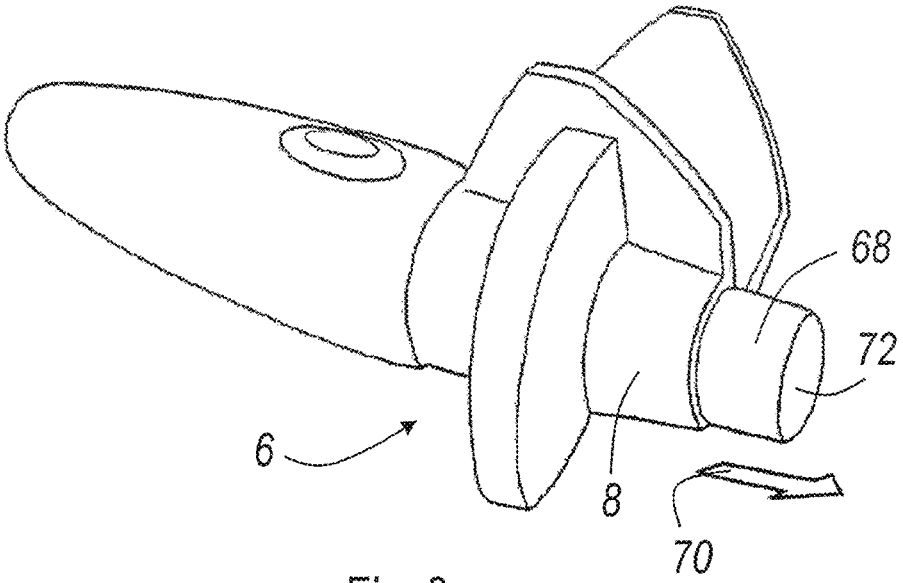
FIG. 8 is a perspective view of a variant of the device shown in FIG. 1.

FIG. 8 shows a further variation of the device 1 wherein a spacer 68 is provided extending from the end of the front chamber 8. The spacer 68 is extendible in the direction of arrow 70, and once it has been adjusted to a pre-determined length, the distal end 72 of the spacer 68 can be held against the head of a user during each step of the styling process to ensure that each length of hair 42 to be treated is curled to a consistent point. The spacer 68, which may be telescopic, is shown in FIG. 8 as having a diameter approximately equal to the front chamber 8. Alternatively, the spacer 68 could extend from the centre of the end face 12 of the front chamber 8, being stored in its unextended state within the elongate protrusion 36. Alternatively the spacer 68 could be provided separately on the outside of the housing 6.

Figure 9:
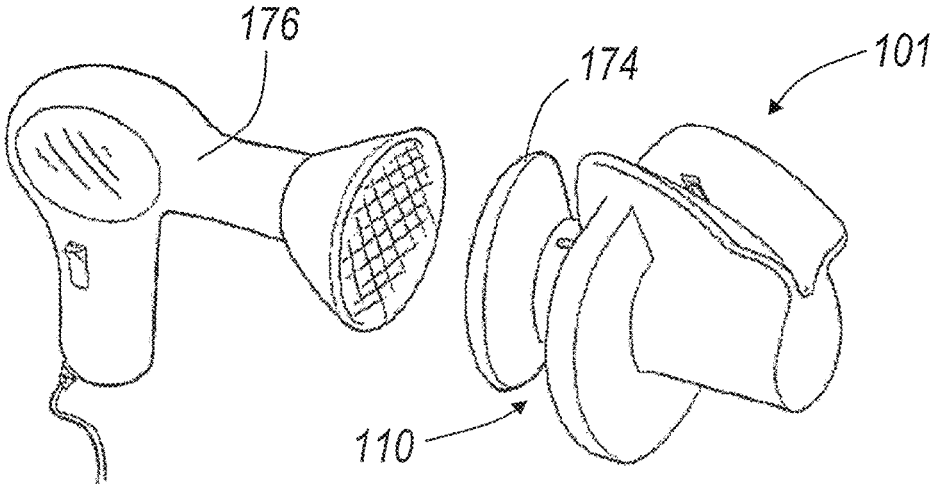
FIG. 9 is a perspective view of a hair styling device according to a second embodiment of the present invention.
Figure 10:
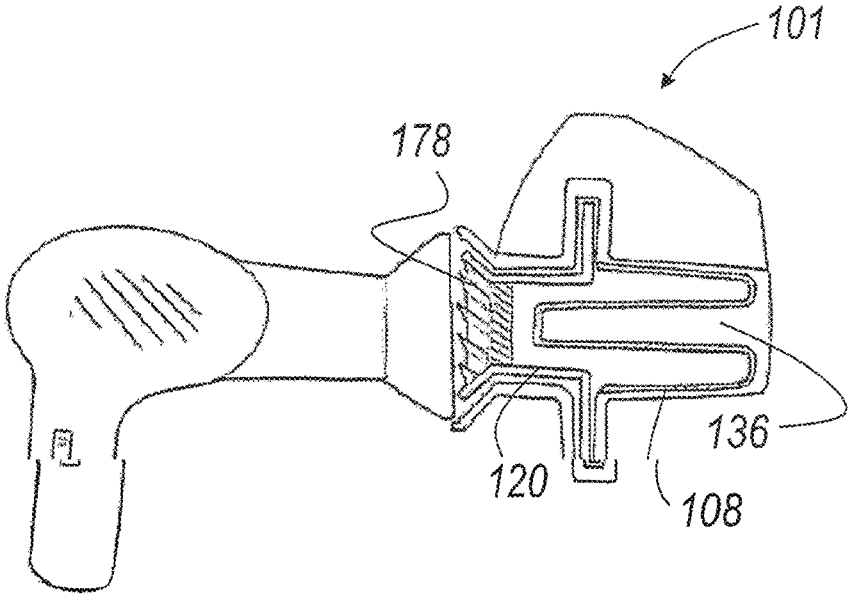
FIG. 10 is a cross-sectional view of hair styling device of FIG. 9.

A further embodiment of the invention is shown in FIG. 9. The device 101 of FIG. 9 is broadly similar to that previously described, but the handle portion of the earlier device 1 has been omitted, and the rear chamber 110 has been adapted to include an open larger diameter portion 174 to fit onto a hairdryer 176. The workings of this second embodiment are more clearly shown in the cross-sectional view of FIG. 10. Instead of being driven by a motor, the rotatable element 120 in this embodiment is provided with an impeller 178 which is driven by the flow of air exiting the hairdryer 176. Products suitable for protecting/styling the hair may be infused into the airflow from the hairdryer 176, and the walls of the front chamber 108 and elongate member 136 may be heated as before. Alternatively, or additionally, the air expelled by the hairdryer 176 could be allowed to pass into the front chamber 408 of the housing 406. The device 401 would then be suitable for use in setting curls into wet hair as it is dried.

Aside from the means of rotating the different rotatable elements 20,120, the operation of the device 101 is essentially the same as that of the device 1 of the first embodiment, and will not be repeated here.

Figure 11B:
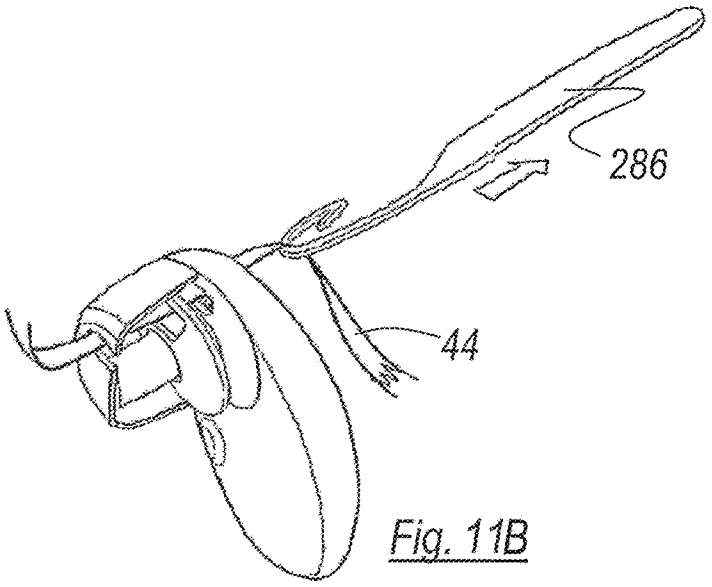
FIGS. 11A to 11D are perspective views of a hair styling device according to a third embodiment of the present invention, showing the device in operation.
Figure 11D:
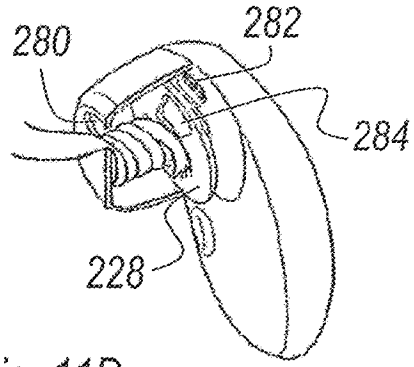
Figure 11A:
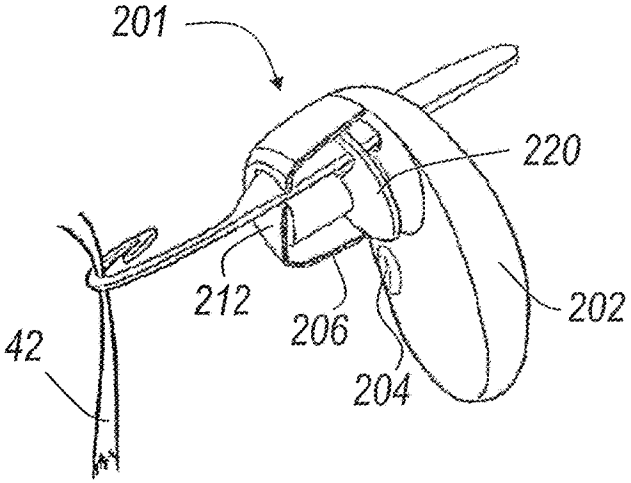
Figure 11C:
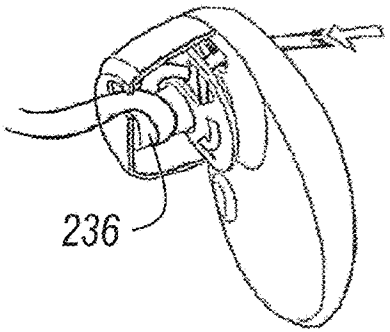

FIGS. 11A to 11D show another embodiment of the present invention. As shown in FIGS. 11C and 11D, in operation the device 201 is the same as that 1,101 of the previous embodiments. The significant physical differences will be described below.

The device 201 shown in FIGS. 11A to 11D is in a pistol-like configuration, with the axis of the housing 206 arranged at right angles to the handle 202, and a trigger style control 204 for operating the device. The housing 206 is simplified in comparison to earlier embodiments, taking the form of gently tapered or cylindrical tube with one end 212 enclosed, and does not comprise clearly distinct front and rear chambers. The housing 206 also lacks the slot of earlier embodiments, instead relying on an opening 280 in the enclosed end 212, and a further opening 282 extending through the handle 202 of the device 201. The rotatable element 220 is also shown as having a fully closed aperture 284 in the disc portion 228, through which hair is to be passed, but the device 201 would work equally well if the disc 228 merely comprised a cut-out section 21 as previously described.

Since there is no slot in the housing 206 of this embodiment, a hook tool 286 must be used to select a length of hair 42 and draw it through the device 201 as clearly shown in FIGS. 11A and 11B. The hook tool 286 is well known in the field of hairdressing, and will not be described further here. Despite not having distinct front and rear chambers, in use the length of hair 42 is still wrapped around the elongate member 236 on the side of the disc 228 distal from the handle 202 of the device 201, as is the case in earlier embodiments. The part of the length of hair 42 which is passing through the aperture 284 in the disc 228 of the rotatable element 220 is rotated relative to the housing 206, while a further part of the length of hair 42 is prevented from rotation by the static aperture 280 in the enclosed end 212 of the housing 206. This wraps the length of hair 42 around the elongate member 236 while simultaneously drawing the free end 44 of the hair into the housing 206 through the aperture 282 in the handle 202 of the device 201.

Figure 12:
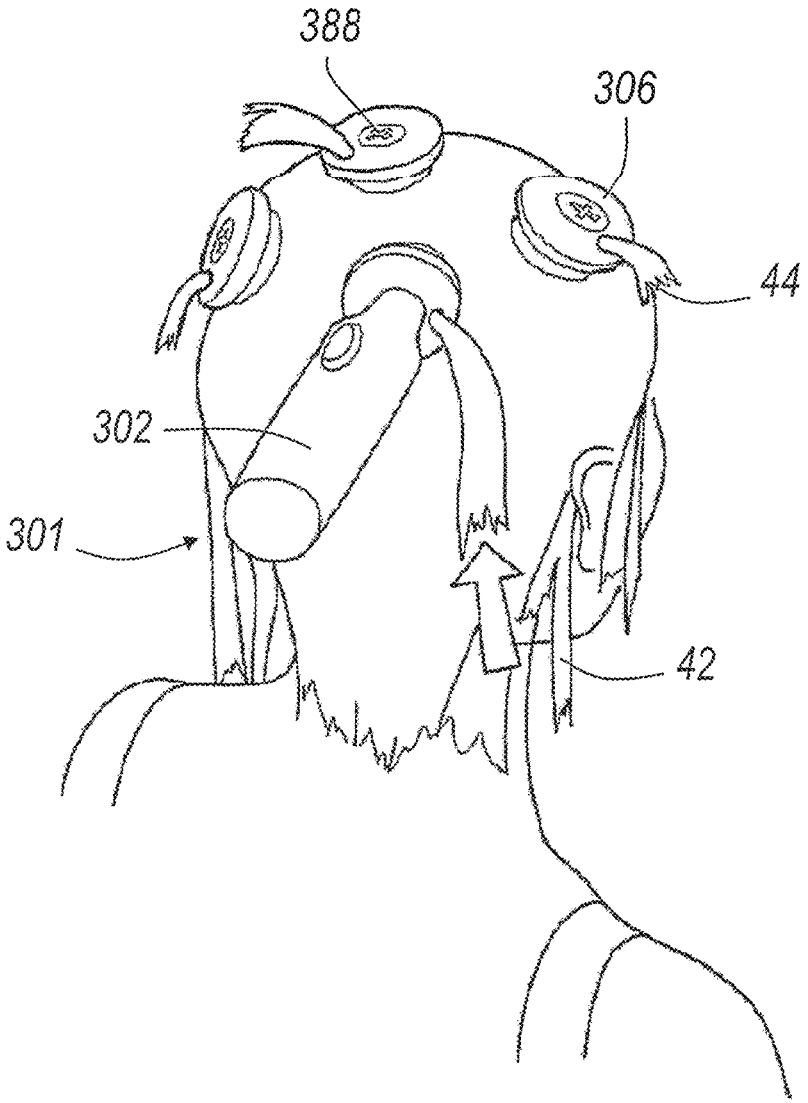
FIG. 12 is a perspective view of a head of hair being styled by a device according to a fourth embodiment of the present invention.

In one particular embodiment of the invention, it is envisaged that the housing 6,106,206, or at least a part thereof, should be detachable from the remainder of the device 1,101,201. This would allow a first length of hair 42 to be wound around a protrusion 36,136,236 and then left to allow the style to 'set' while a user moved on to treat a further length of hair 42, thus speeding up the styling process. This embodiment, which is illustrated in FIG. 12, would be of particular interest to professional hair stylists using the device 1,101,201 in a salon environment, but could also be of interest to home users. Although the device 301 shown in FIG. 12 has a wand-like configuration similar to the first embodiment described, there is no reason why the pistol type device 201 could not be configured in the same way.

As shown in FIG. 12, the housing portions 306 are similar to those 206 of the embodiment of FIG. 11A to 11D, with an aperture through which the hair is drawn rather than a slot in the housing. This gives the advantage that, in use, the free end 44 of the length of hair 42 can be left extending out of the distal end of the housing 306 to retain the hair within the housing 306 once the handle 302 of the device 301 is removed. A similar effect is achievable with the variant comprising a slot 16 in the housing 6, although it may be necessary to include a separate means of maintaining the hair in the housing section 6.

By way of example, and with reference to the exploded view of FIG. 6, the handle 2 may be detachable from the housing 6 of the device 1 by way of releasable connection means. The incorporation of gripping means (not shown) on, for example, the elongate protrusion 36 or housing 6 would then allow the housing to remain on one section of a user's hair, while the handle 2 is connected to a further housing portion for styling another section of hair. The device 1 may, alternatively, be configured so that the releasable connection means are positioned at any point between the handle 2 and the rotatable element 20, such as the point between the front wider diameter portion 14 and the rear chamber 10, since a user's hair, after curling, is retained on the side of the rotatable element 20 distal from the handle 2. It is likely, however, that the releasable connection will be adjacent either the handle 2 or the rotatable element 20.

Where the detachable housing feature is to be included, a releasable connection should be provided to transfer rotational movement from the handle 2 to the rotatable element 20. This could take the form of a split shaft with a suitable torsionally secure coupling provided at or near the position of the releasable connection means of the device 1. The coupling between the two parts of the split shaft could be formed, for example, by a cross-head formed in the end of a first part of the shaft, for engagement with a cross-shaped socket provided in the end of a second part. Alternatively, a similarly arranged hexagonal or square head and socket arrangement, or any other suitable torsionally resistant coupling could be used. Referring again to FIG. 12, the housing portions 306 of the device 301 are shown with cross-shaped sockets 388 so that torsion from the output of the handle 302 can be transferred thereto.

A further embodiment of the invention is shown in FIG. 12. In this embodiment, the device 401 comprises an elongate member 436 configured as a substantially cylindrical rod shaped protrusion extending from the handle 402 of the device 401. A substantially tubular housing 406 is provided around the elongate member 436 such that an annular chamber 408 is formed between the walls of the housing 406 and the elongate member 436. A first end of the housing 406 is located adjacent the end of the elongate member 436 distal from the handle 402. Said first end of the housing 406 is largely enclosed by a substantially planar end wall 412. A sector of the wall 412 is removed to provide an aperture 480 allowing access into the chamber 408 through the end wall 412.

The cylindrical side wall of the chamber 406 extends along a portion of the length of the elongate member 436 towards the elongate handle 402. At a second end, adjacent the handle 402 of the device 401, the housing 406 is open around its entire circumference. Although the housing 406 is shown spaced from the handle 402 of the device 401 along the elongate member 436, the housing 406 could extend from the handle 402, and may even be formed integrally therewith.

A door 490 is provided along the entire length of the housing 406 which allows the housing 406 to be opened along a line extending from the aperture 480 in the end wall 412 of the housing 406. The door 490 is hinged along one edge parallel to the elongate member 436. Inside the housing 406 is provided a rotating element 420 in the form of a helical member. The helical member 420 is arranged to rotate independently of both the elongate member 436 and of the housing 406.

Products designed to fix and/or condition and/or protect the hair of a user are applied by the device 401 during use. The products are expelled through a plurality of apertures 492 provided in the elongate member 436 within the chamber 406. Because of the heat of the device 401, any products quickly vaporise in the chamber 406, ensuring a good distribution of product onto the hair. The largely enclosed nature of the chamber 406 also allows the majority of product used to reach the hair rather than being lost to the atmosphere, as can often be the case with traditional methods. This also reduces the possibility of a user being caused to breathe in products during use of the device 401, which could be hazardous.

Figure 13:
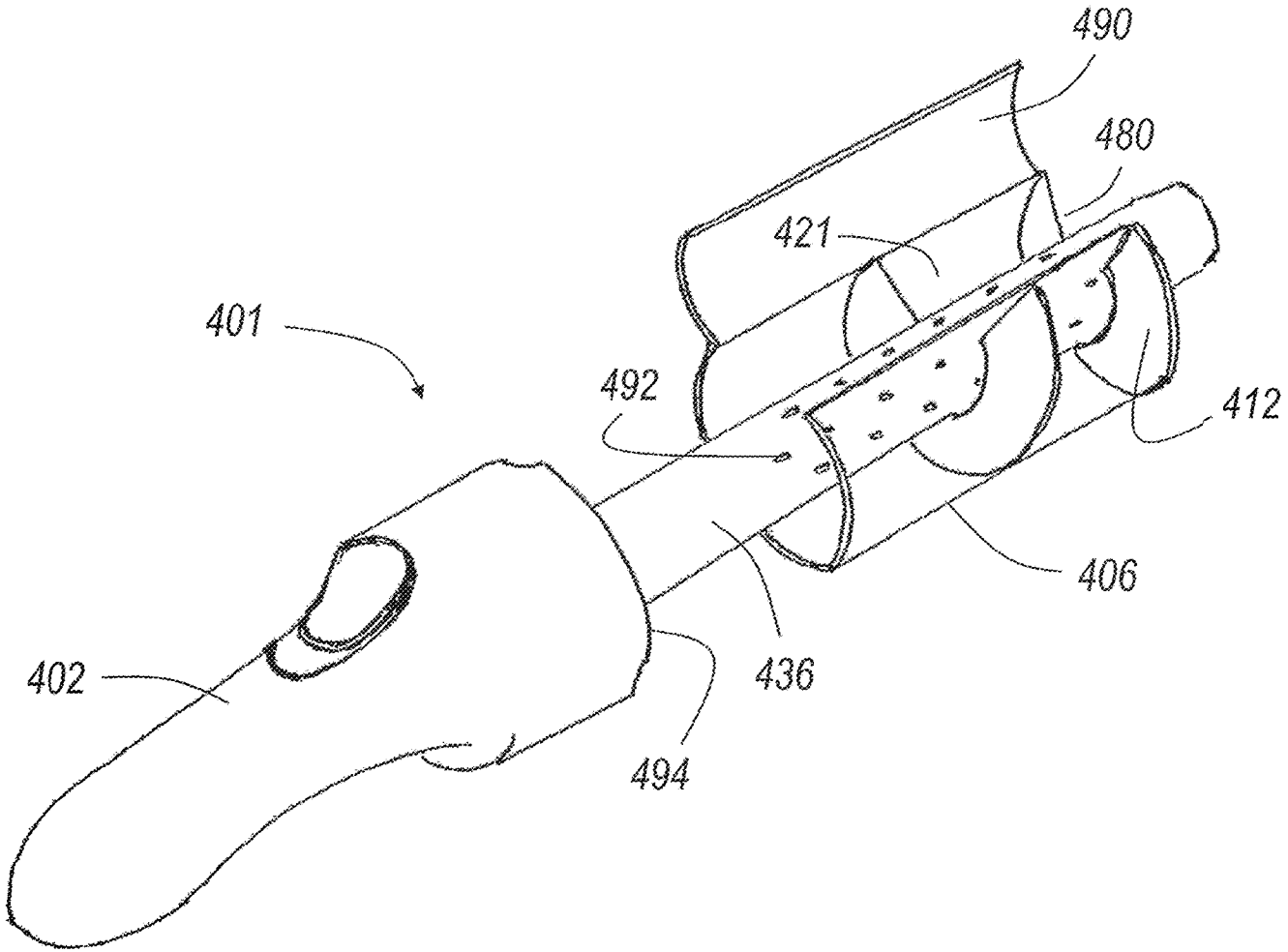
FIG. 13 is a perspective view of a handle of a hair styling device according to a fifth embodiment of the present invention.

The curling process of the device 401 of FIG. 13 is similar to that of the device 1 of FIG. 1. Once at a suitable temperature, the door 490 in the cylindrical wall of the housing 406 is opened, and a length of hair (not shown) is placed into the opening provided, parallel with the elongate member 436 of the device 401. The open door 490 advantageously provides a sloping surface to help guide the hair into the device 401, where it is located in a gap 421 provided in the helical member 420. The door 490 is then closed to enclose a portion of the hair within the housing 406. When the device 401 is activated, the helical member 420 is caused to rotate relative to the handle 402 and to the chamber 406, drawing the free end of the hair into the chamber 406 and coiling it around the elongate member 436 on the side of the helical member 420 distal from the free end of the length of hair in a similar way to that described in relation to other embodiments. The length of hair is prevented from simply rotating freely with the helical member 420 by the provision of the static aperture 480 in the end face 412 of the housing 406. While the hair is curled around the elongate member 436, hair styling or treatment products are expelled through the plurality of apertures 492. When the curling is complete, the device 401 is simply withdrawn from the hair, allowing the hair to pass through the aperture 480. The door 490 need not be opened. The door 490 of the device 1 can then be re-opened ready to receive a further section of hair.

As before, continued rotation of the helical member 420 once the entire length of hair has been curled causes no stress to the hair.

In order to set the curls formed by the device 401 into the hair of a user, it is preferable if the hair is cooled before the device 401 is removed. Air may be drawn into the device 401 by rotation of the helical member 420, provided that the speed of rotation is sufficiently high. Alternatively, a fan, or similar, may be provided in the end 494 of the handle 402 adjacent the housing 406 to blow cold air into the chamber 408 before the device 401 is removed from the head of a user. The handle 402 may also comprise a heating element to heat the air being expelled. The device 401 could then be used on wet hair to set curls into the hair while drying it.

Figure 14:
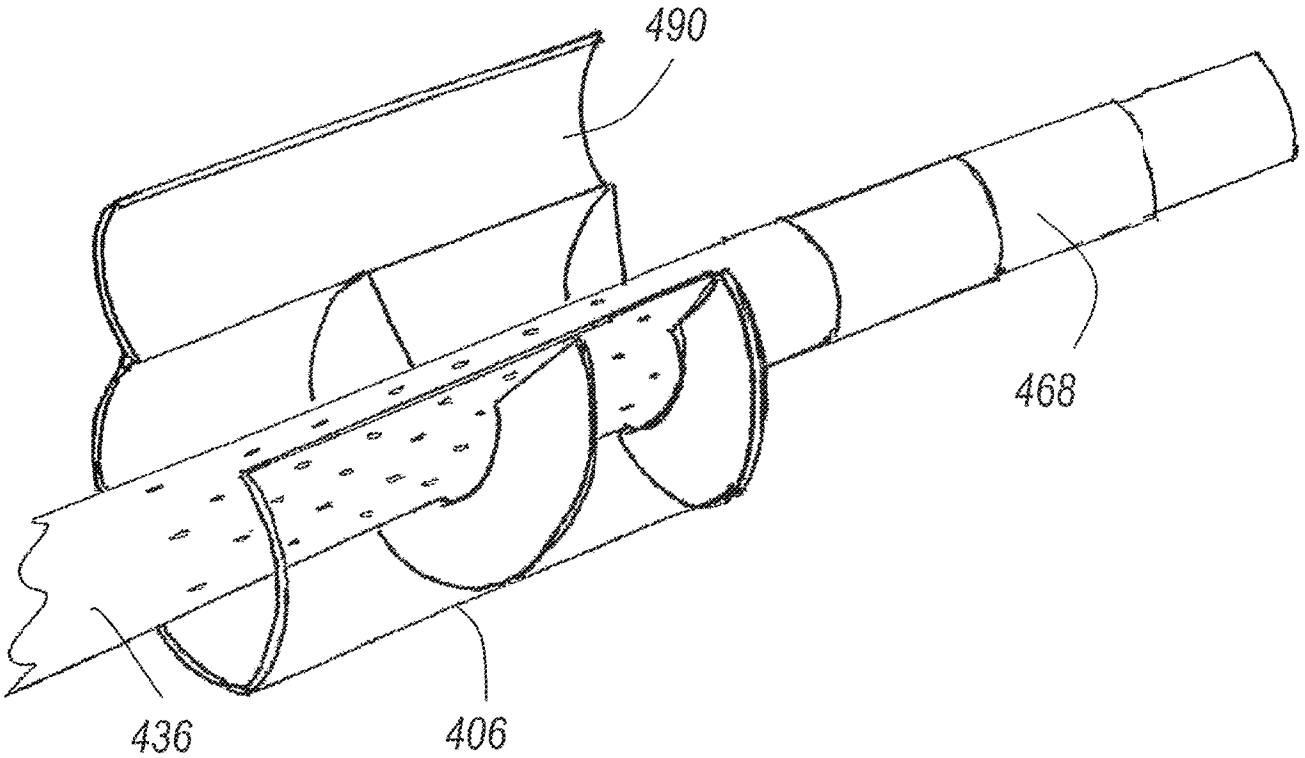
FIG. 14 is a perspective view of a chamber of the hair styling device of FIG. 13.

FIG. 14 shows an alternative, telescopic, spacer 468 extending from the enclosed end 412 of the housing portion 406 of the device 401 of FIG. 13. The telescopic spacer 468 forms a continuation of the elongate member 436 and is used in the same way as the spacer 68 illustrated in FIG. 8.

The invention is not considered to be limited to the specific embodiments described above. Features described in relation to only certain embodiments may also be applied, where compatible, to other embodiments described.

Furthermore, some of the drawings show the housing 206,406 of the device 201,401 as transparent so that details of the rotatable element 220,420 can be clearly seen. In practice, there is no need for the housing 206,406 to be transparent. Indeed, given that the exterior surfaces of the device 201,401 should be cool to the touch, it is more likely that the housing 206,406 will be made from an opaque thermally insulating material.

In the embodiments described, the hair products are dispensed during the curling process. It would also be possible for the dispensing of products to take place after the curling action is complete. The dispensing could take place automatically as the rotatable element is made to rotate, or the product may be selectively dispensed based on a separate user input. Indeed, the device could be made to operate without dispensing any hair products, although the advantages of this feature discussed in the description would, of course, be lost.

The rotatable element could be arranged to rotate in either the clockwise or anticlockwise direction, or could be made to selectively rotate in either direction to allow clockwise or anticlockwise curls to be formed. The rotatable element has been described as comprising either a disc with a cut-out/aperture 20,120,220, or a helical member 420, but may alternatively take any other suitable form including, for example, the form of a simple radial protrusion. Also, the rotatable element may, in certain embodiments, be connected to and/or rotated by the rotation of the elongate member or of the housing. The rotatable element must, however, rotate relative to a static guide means, which in the case of the embodiments shown is provided by a feature of the housing, but may take other suitable means, and may, for example, be attached to a static elongate member.

The invention claimed is:

1. A hair styling aid comprising:

a handle and a housing connected to the handle, the housing having:

a chamber in which a length of hair is received and retained for styling;

a guide for receiving the length of hair to be styled, the guide being provided by a slot in a wall of the housing through which the length of hair is admitted into the housing in use, the slot extending the full length of the chamber;

an elongate member, at least part of which is in the housing;

a rotatable element in the housing and adjacent to the elongate member, the rotatable element being rotatable in a clockwise direction and in an anticlockwise direction relative to the guide and, in use, winding the length of hair around the elongate member in the direction of rotation;

a motor for rotating the rotatable element in a clockwise direction and in an anticlockwise direction;

at least one heating element for heating the chamber;

wherein the rotatable element has:

two hair-pushing surfaces, one of the hair-pushing surfaces being oriented for pushing hair around the elongate member when the rotatable element is rotated clockwise and the other of the hair-pushing surfaces being oriented for pushing hair around the elongate member when the rotatable element is rotated anticlockwise in use.

2. A hair styling aid according to claim 1, wherein the rotatable element rotates relative to the elongate member.

3. A hair styling aid according to claim 1, wherein the rotatable element comprises a disc with a cut-out sector, edges of the disc adjacent to the cut-out sector providing the hair-pushing surfaces.

4. A hair styling aid according to claim 3, having a starting position in which the cut-out sector is aligned with the slot in the wall of the housing.

5. A hair styling aid according to claim 3, wherein the disc is planar.

6. A hair styling aid according to claim 1, wherein each of the hair-pushing surfaces has a terminal end, the radial thickness of the rotatable element increasing away from the terminal end.

7. A hair styling aid according to claim 1, wherein the rotatable element has a cup-like portion.

8. A hair styling aid according to claim 1, wherein the rotatable element is a helical member, and wherein the hair-pushing surfaces are provided by edges of the helical member.

9. A hair styling aid according to claim 1, wherein the rotatable element is a simple radial protrusion extending out from the elongate member, and wherein the hair-pushing surfaces are provided by side edges of the protrusion.

10. A hair styling aid comprising:

a handle, a housing connected to the handle, the housing having:

a chamber in which a length of hair is received and retained for styling;

a guide for receiving the length of hair to be styled, the guide being provided by a slot in a wall of the housing through which the length of hair is admitted into the housing in use, the slot extending the full length of the chamber;

an elongate member, at least part of which is in the housing;

a rotatable element in the housing and adjacent to the elongate member, the rotatable element being rotatable in a clockwise direction and in an anticlockwise direction relative to the guide and, in use, winding the length of hair around the elongate member in the direction of rotation;

a motor for rotating the rotatable element in a clockwise direction and in an anticlockwise direction;

at least one heating element for heating the chamber;

wherein the rotatable element is formed to assist in drawing hair into the hair styling aid during use with:

an opening having:

one over-hang formed to draw hair in and to wind the hair around the elongate member when the rotatable element is driven in the clockwise direction; and another over-hang formed to draw hair in and to wind the hair around the elongate member when the rotatable element is driven in the anticlockwise direction.

11. A hair styling aid according to claim 10, wherein the rotatable element rotates relative to the elongate member.

12. A hair styling aid according to claim 11, wherein the rotatable element has a cup-like portion.

13. A hair styling aid according to claim 10, wherein the rotatable element comprises a disc with a cut-out sector, edges of the disc adjacent to the cut-out sector providing hair-pushing surfaces.

14. A hair styling aid according to claim 13, wherein the disc is planar.

15. A hair styling aid according to claim 10, wherein each of the over-hangs has a terminal end, the radial thickness of the rotatable element increasing away from the terminal end.

16. A hair styling aid comprising:

a housing having a chamber in which a length of hair is received and retained for styling, and a guide for receiving the length of hair to be styled, the guide being provided at a slot in a wall of the housing through which the length of hair is drawn into the housing in use, the slot extending the full length of the chamber;

an elongate member, at least part of which is in the housing;

a rotatable element in the housing and adjacent to the elongate member, the rotatable element being rotatable in a clockwise direction and in an anticlockwise direction relative to the guide and, in use, winding the length of hair around the elongate member;

a motor for rotating the rotatable element in a clockwise direction and in an anticlockwise direction;

at least one heating element for heating the chamber;

wherein the rotatable element is:

a disc having an open section with projecting portions of the disc on opposite sides of the open section adapted to draw hair into the hair styling aid and to wind the hair around the elongate member in the direction of rotation of the disc.

17. A hair styling aid according to claim 16, wherein the rotatable element rotates relative to the elongate member.

18. A hair styling aid according to claim 16, wherein the disc comprises a cut-out section, edges of the cut-out section providing hair-pushing surfaces.

19. A hair styling aid according to claim 18, having a starting position in which the cut-out section is aligned with the slot in the wall of the housing.

20. A hair styling aid according to claim 18, wherein the hair-pushing surfaces are pointed with continuous curvature.

21. A hair styling aid according to claim 16, wherein the disc is planar.

22. A hair styling aid according to 16, wherein the open section is concave with a convexly curved inner portion.

23. A hair styling aid according to claim 16, wherein each of the projecting portions of the disc has a terminal end, the radial thickness of the disc increasing away from the terminal end.

24. A hair styling aid according to claim 16, wherein the rotatable element has a cup-like portion.

* * * * *